US006145967A

United States Patent [19]

Langford et al.

[11] Patent Number: 6,145,967

[45] **Date of Patent: *Nov. 14, 2000**

[54] METHOD AND APPARATUS FOR CONFIGURING A FLUID INTERCONNECT FOR AN INK-JET PRINTHEAD

[75] Inventors: Jeffrey D Langford; James P Kearns; Mark Hauck, all of Corvallis, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/957,245

[22] Filed: Oct. 24, 1997

[51] Int. Cl.[7] ..... B41J 2/175

[52] U.S. Cl. ..... 347/85

[58] Field of Search ..... 347/85, 86, 87

[56] References Cited

U.S. PATENT DOCUMENTS

| | | | |
|---|---|---|---|
| 4,568,954 | 2/1986 | Rosback | 347/86 |
| 4,575,738 | 3/1986 | Sheufelt et al. | 347/94 |
| 4,586,058 | 4/1986 | Yamazaki et al. | 347/92 |
| 4,928,129 | 5/1990 | Asai | 347/86 |
| 5,293,913 | 3/1994 | Preszler | 141/367 |
| 5,675,367 | 10/1997 | Scheffelin et al. | 347/86 |
| 5,815,182 | 9/1998 | Otis et al. | 347/85 |

*Primary Examiner*—N. Le
*Assistant Examiner*—Michael Nghiem
*Attorney, Agent, or Firm*—Kevin B. Sullivan

[57] ABSTRACT

This disclosure relates to an inkjet pen having a fluid inlet configured for connection to a corresponding fluid outlet associated with a supply of ink. The ink-jet pen includes a printhead responsive to control signals for selectively depositing ink. Also included is a printhead housing supporting the printhead. The printhead housing has a configurable fluid inlet portion that is configured for receiving a fluid configuration portion for configuring the configurable fluid inlet portion for connection to the supply of ink. The fluid inlet portion and the fluid configuration portion each configured to have complementary interconnect portions that when press fit together mate to configure the printhead for connection to the ink supply.

10 Claims, 7 Drawing Sheets

SECTION 3B - 3B'

SECTION 5 - 5′

14
30
34
62
32
48
40
36
46
44
16
SECTION 6C - 6C'

6C'
6C
60
Z
Y
X

42

METHOD AND APPARATUS FOR CONFIGURING A FLUID INTERCONNECT FOR AN INK-JET PRINTHEAD

BACKGROUND OF THE INVENTION

The present invention relates to ink-jet printheads that are configurable for use with a particular ink supply of a plurality of ink supplies. More particularly, the present invention relates to an ink-jet printhead and a fluid configuration portion for configuring the ink-jet printhead for connection to the selected ink supply for accomplishing ink-jet printing.

Ink-jet printers frequently make use of an ink-jet printhead mounted to a carriage that is moved back and fourth across a print media, such as paper. As the printhead is moved across the print media, a control system activates the printhead to deposit or eject, ink droplets onto the print media to form images and characters.

One type of ink-jet printer previously used makes use of a replaceable ink cartridge. The ink cartridge includes a printhead and an ink reservoir that are contained within a cartridge housing. When the ink reservoir is depleted of ink or a different type of ink is required for a particular print media the entire ink cartridge is replaced.

Another type of ink-jet printer, disclosed in patent application Ser. No. 08/566,521 assigned to the assignee of the present invention, makes use of an ink-jet printhead and an ink supply that can each be separately replaced. For this type of ink-jet printer the ink supply is spaced from the printhead. The printhead is mounted to the carriage and ink is provided to the printhead by way of a flexible fluid interconnect extending between the ink supply and the printhead. For this type of arrangement, the ink supply container can be replaced without replacing the printhead. The printhead is then replaced at the printhead end of life.

For this type of printing system where the printhead is separately replaceable from the ink container it is crucial that the printhead form a reliable fluid interconnect with the supply of ink. The fluid interconnects between the printhead and the printing system should be capable of repeated connection and disconnnections without ink spillage. Inks used in ink-jet printing typically contain components such as surfactants that when spilled on electrical components within the printing system tend to produce reliability problems within the printing system.

In addition, this fluid interconnect between the printhead and printing system should be capable of providing adequate ink flow rates while minimizing the introduction of air into the fluid conduit. Air introduced into the fluid conduit accumulates in the inkjet printhead. If the accumulated air in the printhead becomes too great the ability of the printhead to regulate the backpressure of the printhead can be hindered tending to result in printhead drool or a reduction in print quality.

The printhead fluid interconnect should be suitable for use in a wide variety of printing systems. Some printing systems place a high premium on size. The reduction in the size of the fluid interconnect allows the printing system to be more compact. Therefore, the fluid interconnects between the printhead and the ink supply should be capable of being compact for use in printing applications where size is a premium.

Finally, it is crucial that inks having different ink parameters, such as ink color and ink family, be prevented from interacting in a manner which can reduce the quality of the output image. For example, inks of different colors must not be intermixed. In addition, inks from different ink families must not be intermixed. Therefore, the printhead should be capable of being configured for connection not only for the particular printing system, but also, the printhead should be capable of being configured for connection to the selected ink type or ink color within the printing system. This fluid interconnect system should also be cost effective and easily manufactured to reduce the manufacturing costs of the overall printing system.

SUMMARY OF THE INVENTION

The present invention relates to an ink-jet pen having a fluid inlet configured for connection to a corresponding fluid outlet associated with a supply of ink. The ink-jet pen includes a printhead responsive to control signals for selectively depositing ink. Also included is a printhead housing supporting the printhead. The printhead housing has a configurable fluid inlet portion that is configured for receiving a fluid configuration portion for configuring the configurable fluid inlet portion for connection to the supply of ink. The fluid inlet portion and the fluid configuration portion each configured to have complementary interconnect portions that when press fit together mate to configure the printhead for connection to the ink supply.

Another aspect of the present invention is the fluid configuration portion configured for connection to an ink-jet printhead of the type having a housing defining a bore. The fluid configuration portion includes a first connector configured for insertion into the bore to form a snap fit between the first connector and the printhead housing. Also included a second connector in fluid communication with the first connector. The second connector is configured for connection to the ink supply.

DETAILED DESCRIPTION OF THE PREFERRED EMBODIMENT

Figure 1:
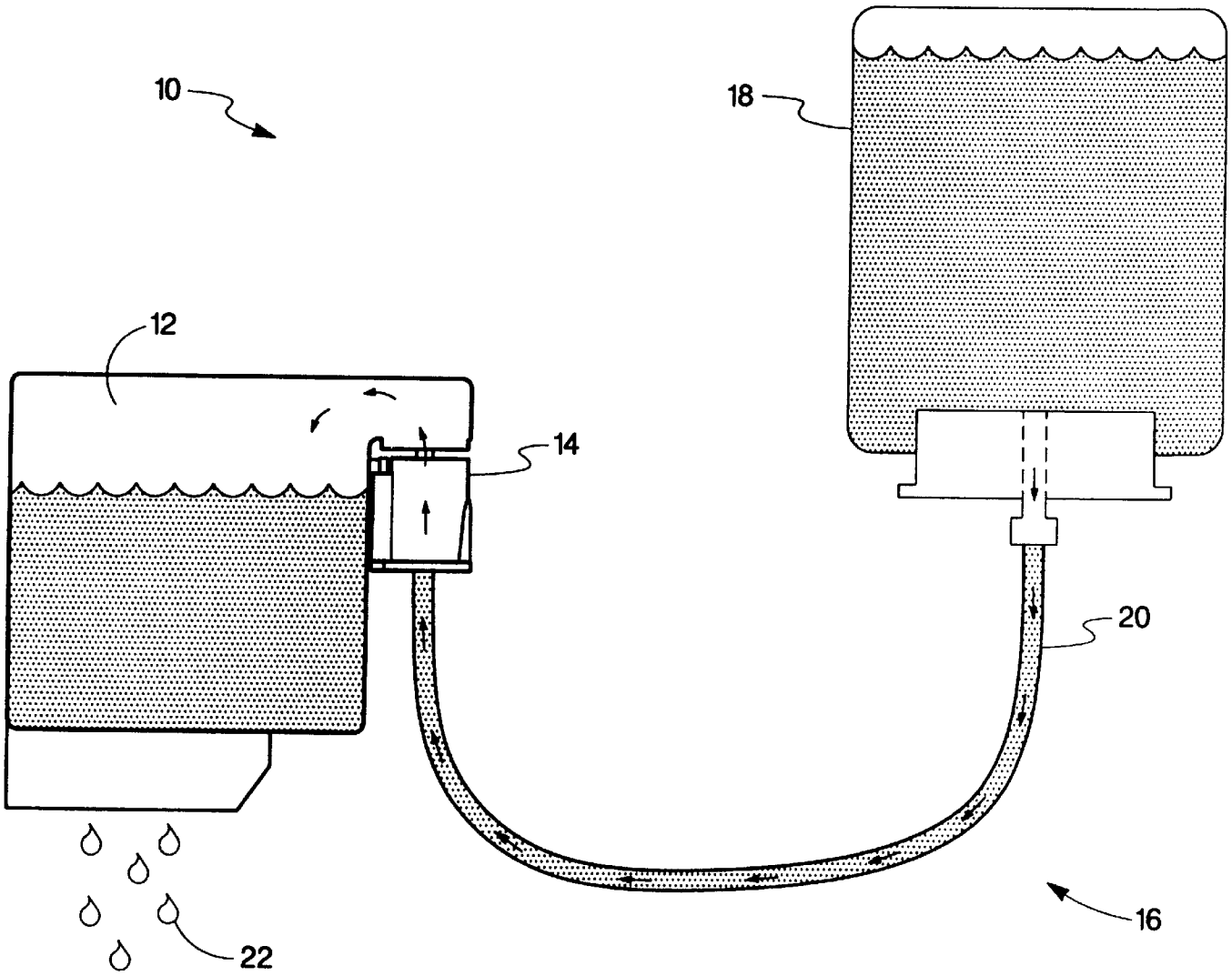
FIG. 1 depicts a schematic representation of the ink-jet printing system of the present invention that includes a fluid configuration portion for configuring an ink-jet pen for connection to a supply of ink.

FIG. 1 depicts a schematic representation of an ink-jet printing system 10 of the present invention. The ink-jet printing system 10 includes an ink-jet printhead 12 for selectively depositing ink on print media and a fluid configuration portion 14 for configuring the printhead 12 for connection to a supply of ink 16. The supply of ink 16 includes an ink container 18 and a flexible conduit 20 providing fluid communication between the ink container 18 and the fluid configuration portion 14.

The printhead 12 is selectively activated by a print controller (not shown) to eject droplets of ink 22 as the printhead 12 is moved relative to print media. In one preferred embodiment, the printhead 12 is mounted in a scanning carriage and the ink container 18 is mounted stationary relative to the scanning carriage and spaced from the scanning carriage. Ink, provided by the ink container 18, replenishes the printhead 12 with ink. The printhead 12 typically includes a regulator (not shown) for regulating an internal gauge pressure of the printhead 12. By regulating the internal gauge pressure of the printhead 12 a negative back pressure is maintained for preventing printhead drool during changes in environmental conditions such as atmospheric pressure changes.

The ink container 18 shown is a non-pressurized ink container in which ink is drawn into the printhead 12 by the negative backpressure within the printhead, by capillary pressure or by gravity. Alternatively, the ink container 18 may be a pressurized ink container for providing a pressurized supply of ink to the printhead 12.

An important aspect of the present invention is the ability to configure the printhead 12 for connection to the ink supply 16 selected from a plurality of ink supplies. The fluid configuration portion 14 is selected from a plurality of fluid configuration portions to properly configure the printhead 12 for connection to the selected supply of ink 16. Once the proper fluid configuration portion 14 is attached to the printhead 12 fluid communication between the printhead and the fluid configuration portion is established. The printhead 12 is then configured for connection to the selected ink supply 16 for establishing fluid communication between the selected ink supply 16 and the printhead 12. Therefore, the use of a fluid configuration portion 14 together with the printhead 12 allows the printhead 12 to be configured for use in a variety of printing systems. With each of these varieties of systems having a variety of different ink supplies 16 each requiring a different fluidic interface. The fluid configuration portion 14 when properly connected to the printhead 12 provides a highly reliable mechanical and fluidic interconnect with the printhead 12, as will be discussed in more detail later.

Figure 2:
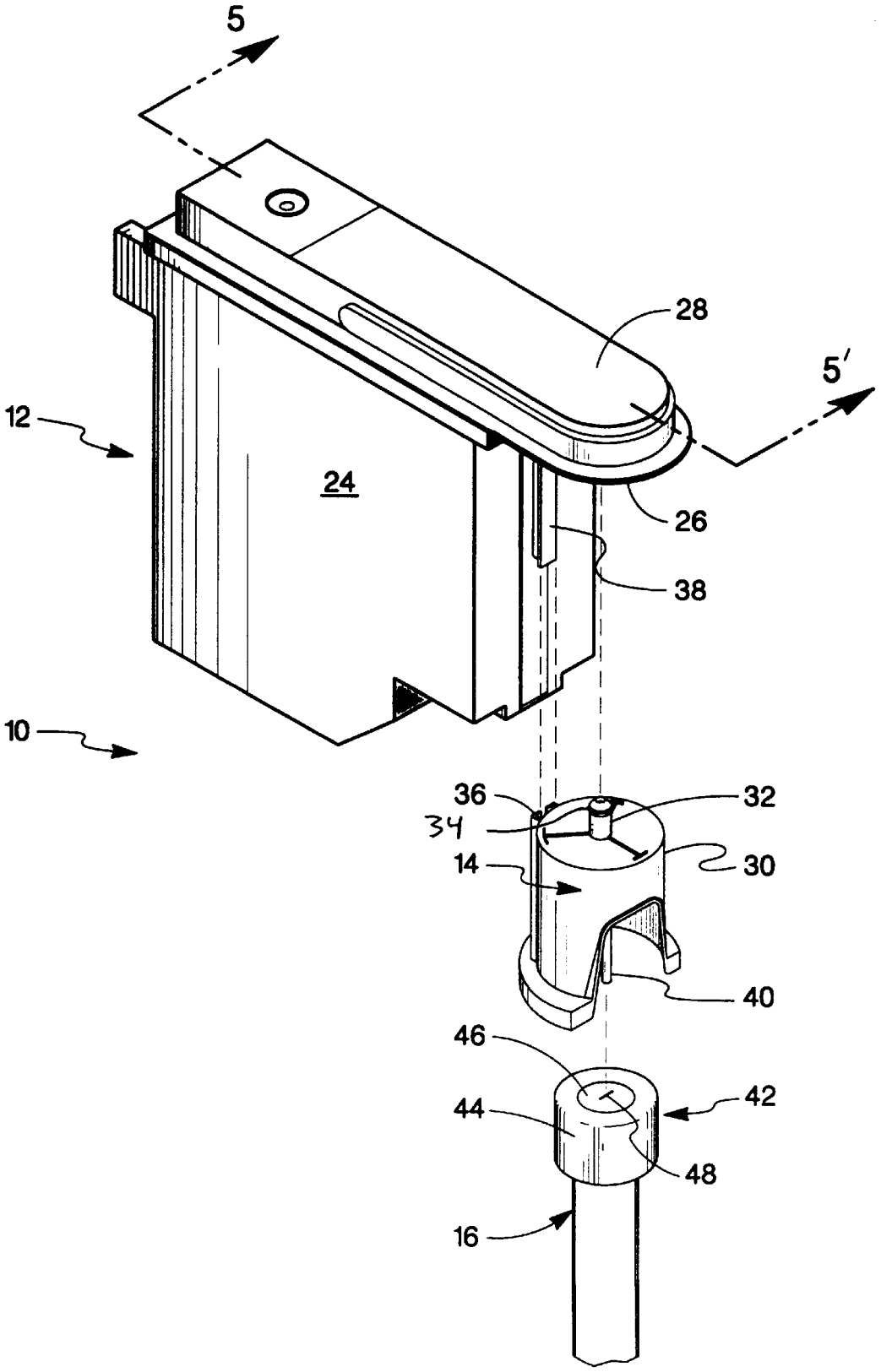
FIG. 2 depicts an exploded view of fluid configuration portion of the ink-jet printing system of FIG. 1.

FIG. 2 depicts an exploded view of the printing system 10 showing the fluid configuration portion 14 spaced from each of the printhead 12 and the supply of ink 16. The printhead 12 has a housing or body that includes a reservoir portion 24, a fluid inlet portion 26 attached to the reservoir portion 24 and a cap portion 28 attached to the fluid inlet portion 26. The fluid inlet portion 26 and cap 28 are in fluid communication with the reservoir 24. The fluid inlet 26 is configured for connection to the fluid configuration portion 14.

The fluid configuration portion 14 includes a housing 30 having a first-end configured for connection to the fluid inlet 26 associated with the printhead 12 and a second-end configured for connection to the ink supply 16. The first-end of the housing 30 includes a projection portion 32 having a flange 34 extending therefrom. As will be discussed in more detail with respect FIG. 6, the projection portion 32 is a hollow cylindrical portion that is press fit into the fluid inlet 26 to form a snap-fit connection between the fluid configuration portion 14 and the printhead 12.

The fluid configuration portion 14 also includes a guide portion 36 that together with the complementary guide portion 38 associated with the printhead 12 engage to guide the projection portion 32 into the fluid inlet 26. The complimentary guiding portions 36 and 38 associated with the fluid configuration portion 14 and printhead 12, respectfully, are discussed in more detail with respect to FIG. 4.

The second-end, opposite the projection portion 32, is a fluid interconnect configured for connection to the ink supply 16. In the preferred embodiment, the fluid interconnect at the second-end is a hollow needle 40 having a blind bore. The hollow needle is in fluid communication with the hollow projection portion 32. In this preferred embodiment the ink supply 16 includes a fluid interface 42. The fluid interface 42 includes a crimp-cap 44 that holds a septum 46 in position. The septum 46 has a slit 48 for receiving the needle 40 to establish fluid communication between the ink supply 16 and the fluid configuration portion 14. The housing 30 of the fluid configuration portion 14 provides a guide for the crimp-cap 44 such that the needle 40 is properly aligned with the slit 48 during insertion.

Figure 3A:
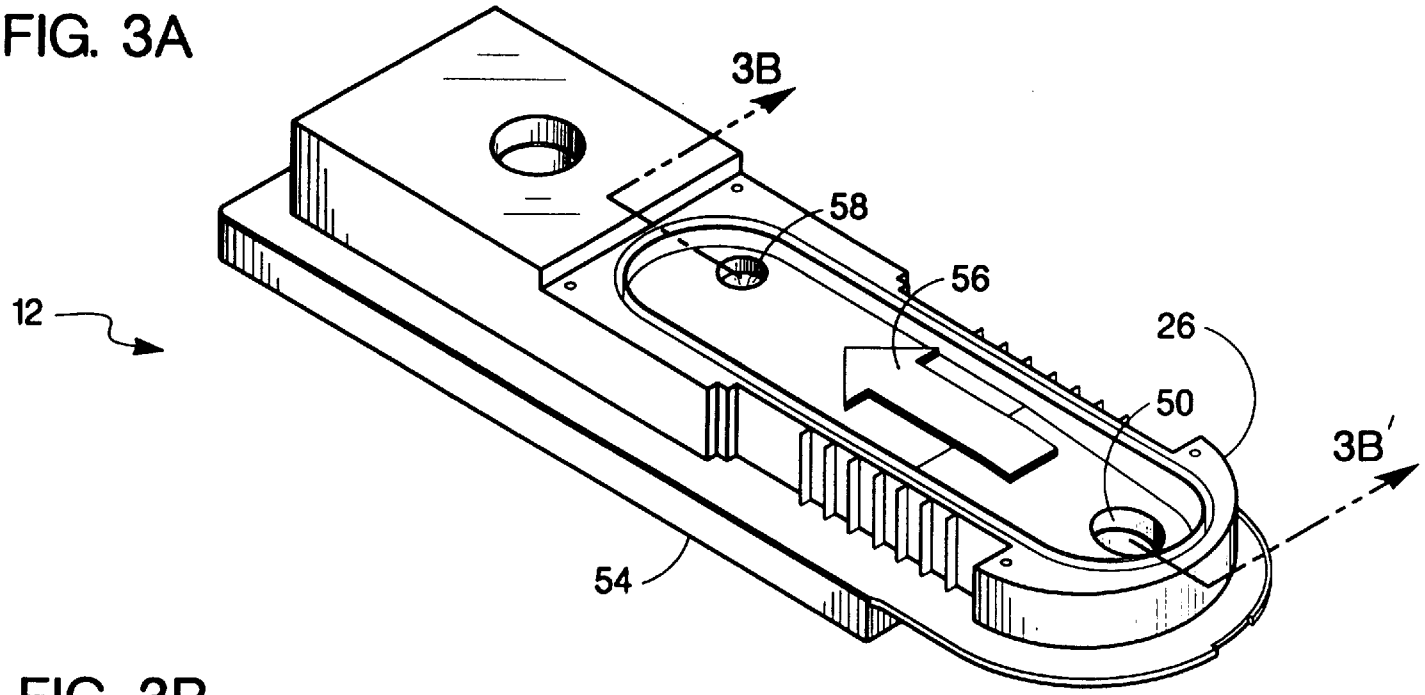
FIGS. 3A and 3B depict a fluid inlet portion of the ink-jet pen shown in perspective and in section, respectively.
Figure 3B:
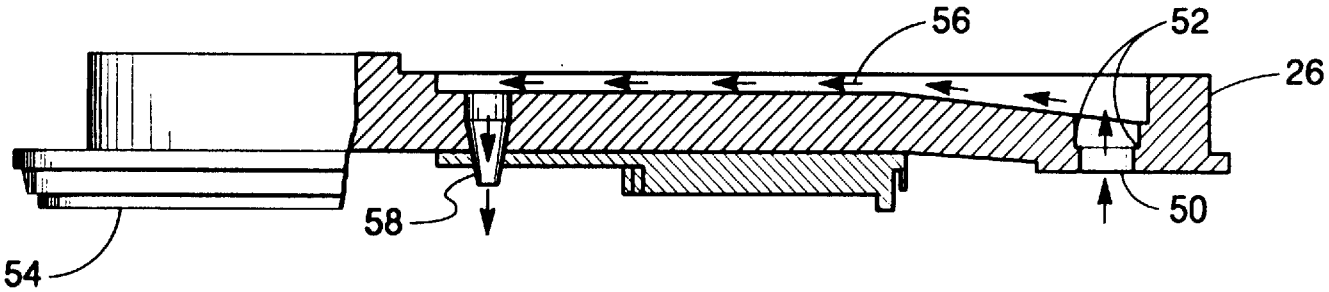

FIGS. 3A and 3B depict greater detail of the fluid inlet portion 26 of the printhead 12. The fluid inlet portion 26 includes a bore 50 for receiving the hollow projection portion 32 of the fluid configuration portion 14. The fluid inlet portion 26 also includes a shoulder or seat portion 52 adjacent the bore 50. The seat portion 52 engages the flange 34 as the projection portion 32 is inserted into the bore 50. A seal 54 is provided on the fluid inlet 26 for providing a fluid seal between the fluid inlet 26 and the reservoir portion 24. With the fluid inlet portion 26 properly sealed to the reservoir 24 ink travels along a path represented by arrows 56 from the bore 50 along a top portion of the fluid inlet 26 and down through bore 58 into the reservoir portion 24 of the printhead 12.

Figure 4B:
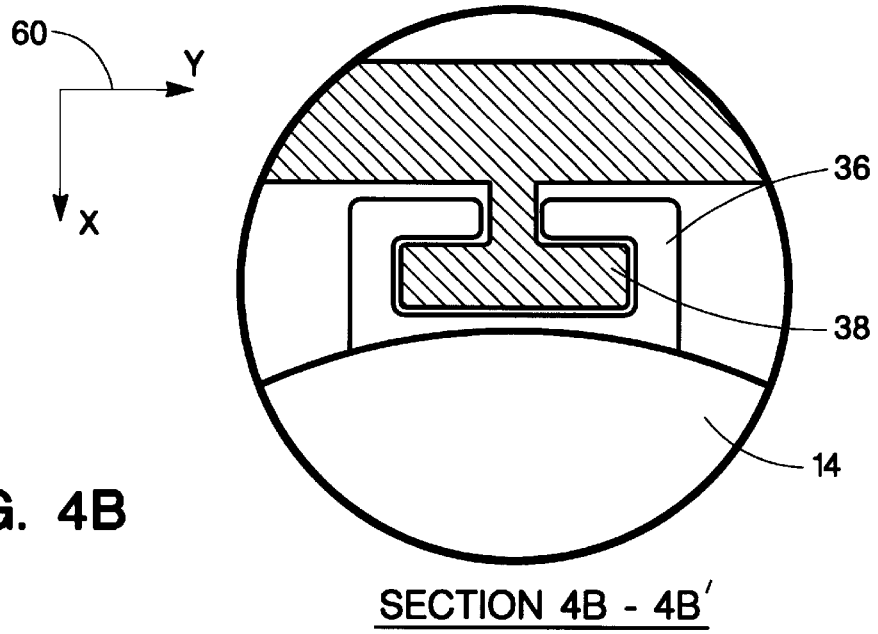
FIGS. 4A and 4B depict a guiding feature on each of the ink-jet pen and fluid configuration portion shown in perspective and in section, respectively.
Figure 4A:
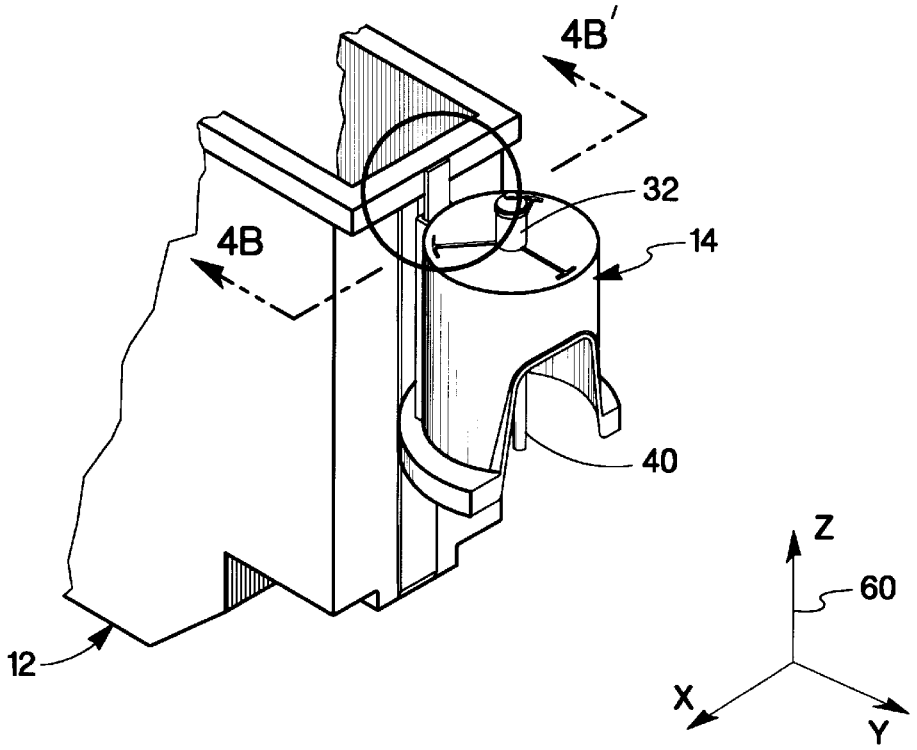

FIGS. 4A and 4B depict the guiding features 36 and 38 on the fluid configuration portion 14 and printhead 12, respectively, for aligning the projection portion 32 with the bore 50 during attachment of the fluid configuration portion 14 with the printhead 12. The guiding portion 38 is a raised rib that extends generally along the insertion direction represented by the Z axis on coordinate system 60. The guide feature 36 associated with the fluid configuration portion 14 has a complimentary shape to the guiding feature 38 for preventing or limiting movement in the X and Y directions as the fluid configuration portion 14 is inserted along the Z direction. By limiting or constraining motion along the X and Y axes, the guiding features 36 and 38 together ensure alignment of the hollow projection portion 32 with the corresponding bore 50 associated with the printhead 12 during insertion. In addition, the guiding features 36 and 38 provide structural support for the fluid configuration portion 14 once the projection portion is snap-fit into the bore 50 thereby preventing or limiting damage to the fluid configuration portion 14 during insertion of the printhead 12 together with the fluid configuration portion 14 into a printing system.

Figure 5:
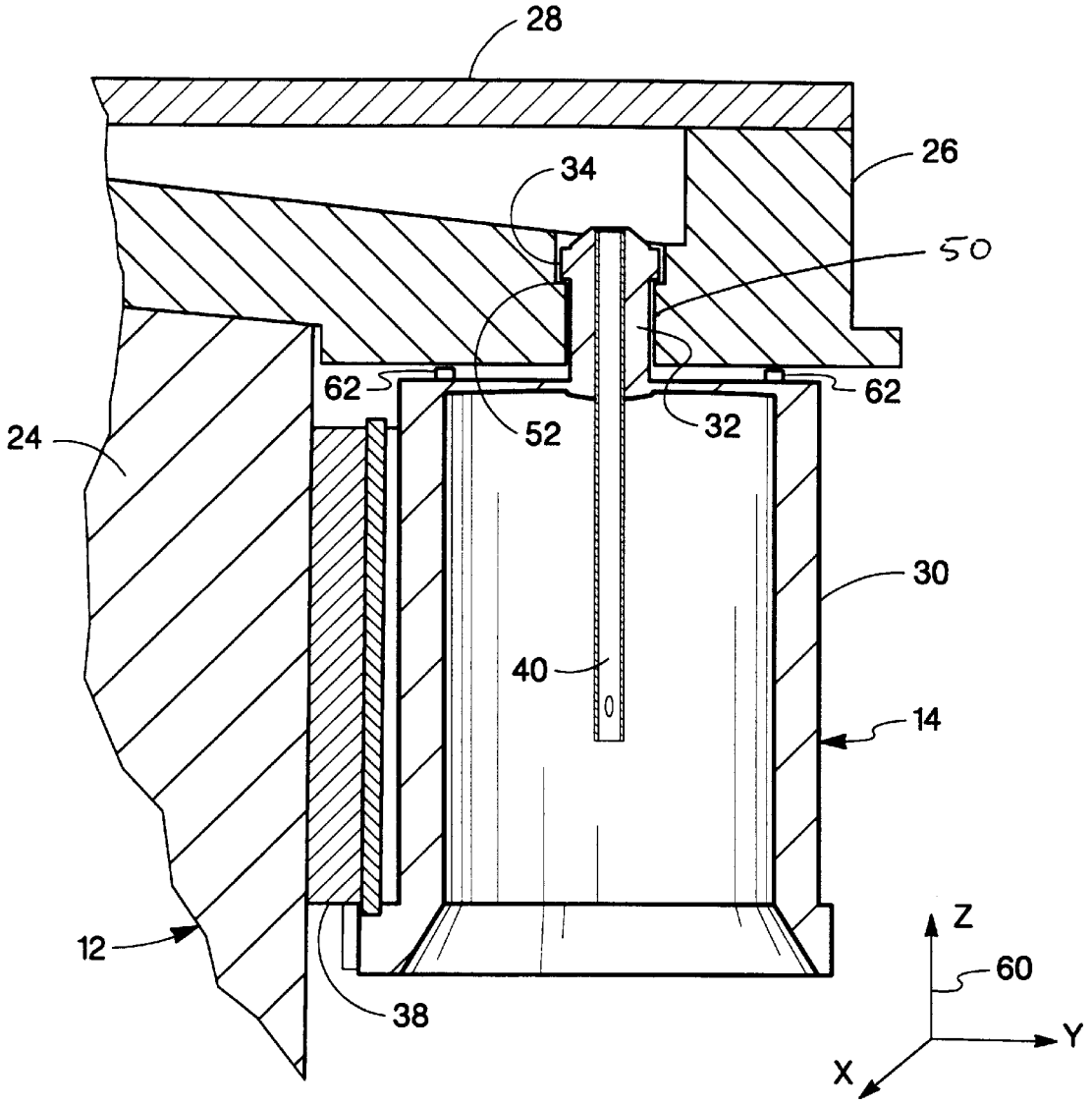
FIG. 5 depicts the ink-jet pen with the fluid configuration portion attached thereto shown partially broken away in a greatly enlarged section view.

FIG. 5 depicts a section view of the fluid configuration portion 14 properly positioned in a locked or snapped into the fluid inlet portion 26 of the printhead 12. It can be seen from FIG. 5 that once the hollow projection portion 32 is inserted into the bore 50 in the fluid inlet 26 the flange portion 34 engages the seat 52 to prevent or resist removal of the projection portion 32 from the fluid inlet 26.

The projection portion 32 is formed from a compliant material that is compressed during insertion through the bore 50. The compliant material then expands allowing the flange 34 to expand to engage the seat 52 once fully inserted. In one preferred embodiment the fluid configuration portion 14 is formed from a polypropylene material which is elastic at normal operation temperatures. A plurality of stand-offs 62 are provided on the fluid configuration portion 14 to engage the fluid inlet portion 26 to ensure a compressive seal is formed between the flange 34 and the seat 52 thereby preventing ink leakage from the printhead 12 between the bore 50 and the projection portion 32.

Once the fluid configuration portion 14 is snapped into place, as shown in FIG. 5, within the printhead 12 the fluid configuration portion 14 is difficult to remove from the printhead 12. In one preferred embodiment, the fluid configuration portion 14 cannot be removed from the printhead 12 without breaking off the projection portion 32. Therefore, the fluid configuration portion 14 and the printhead 12 form a permanent configuration.

It is critical that during the insertion of the printhead 12 together with the fluid configuration portion 14 into the printing system the fluid interconnects associated with the fluid configuration portion 14 and the ink supply 16 be properly aligned. Insertion of the printhead 12 into the printing system usually requires both aligning the printhead for proper positioning in the scanning carriage and aligning the printhead to form a proper fluidic interface with the ink supply 16. Misalignment between the fluid configuration portion 14 and the printhead 12 can result in improper fluid connection between the printhead 12 and the ink supply 16 that can result in ink leakage. The fluidic interface between the ink supply 16 and the fluid configuration portion 14 will be now discussed with respect to FIGS. 6 and 7.

Figures 6A, 6B, 6C:
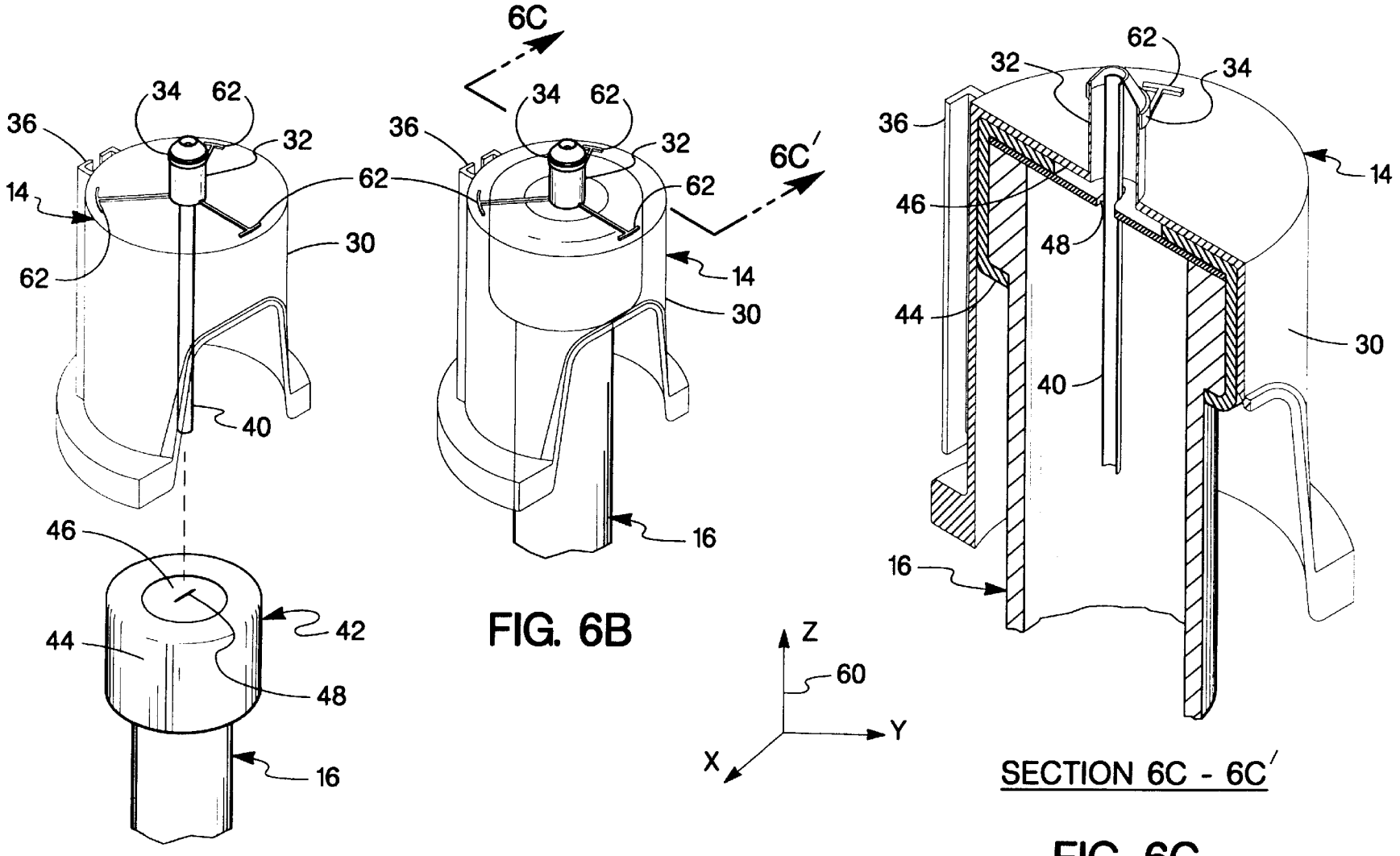
FIGS. 6A, 6B, and 6C depicts a fluid interconnect associated with the supply of ink positioned for insertion into the fluid configuration portion, inserted in the fluid configuration portion, and inserted into the adapter (shown in section), respectively.

FIGS. 6A and 6B depict the fluidic interconnect between the fluid configuration portion 14 and the ink supply 16. FIG. 6A depicts the fluid configuration portion 14 in alignment with the fluid interface 42 associated with the supply of ink 16. FIG. 6B shows the fluid interface 42 associated with the supply of ink inserted into the housing 30 to form a fluidic interconnect between the fluid configuration portion 14 and the supply of ink 16. With the crimp-cap 44 inserted into the housing 30 the hollow needle 40 extends through slit 48 in septum 46 thereby forming a fluid interconnect between the fluid configuration portion 14 and the supply of ink 16. The housing 30 of the fluid interconnect 14 is shown in ghost to better illustrate the insertion of the fluidic interface 42 into the housing 30.

FIG. 6C depicts a section view of FIG. 6B illustrating the hollow needle 40 inserted through slit 48 in septum 46 to establish fluid communication between the fluid configuration portion 14 and the supply of ink 16. It can be seen from FIG. 6C that the housing 30 provides a guide for the leading edge of the fluid interface 42 into proper alignment with the fluid configuration portion 14 thereby insuring that the needle 40 is inserted through the slit 48 in the septum 46.

Figures 7A, 7B, 7C:
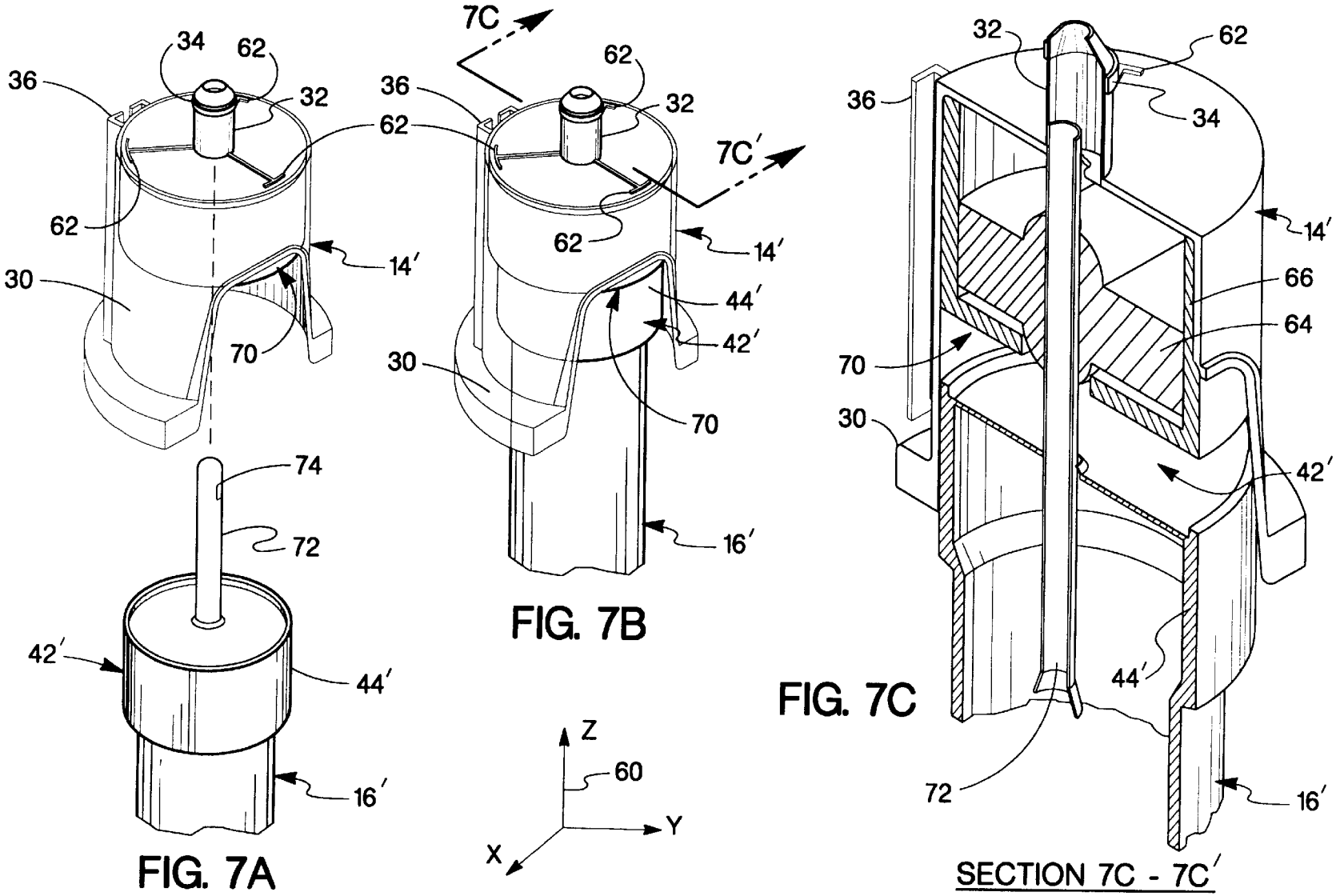
FIGS. 7A, 7B, and 7C depicts an alternative embodiment of the fluid configuration portion of the present invention shown in FIGS. 6A, 6B, and 6C.

FIGS. 7A, 7B and 7C are similar to FIGS. 6A, 6B and 6C except that a fluid configuration portion 14' configures the printhead 12 for connection to a supply of ink 16 having a needle type fluidic interface instead of a septum type fluidic interface performed by the fluid configuration portion 14 shown in FIGS. 6A, 6B and 6C. Similar numbering will be used in FIGS. 7A, 7B, and 7C to identify structures that are similar to those disclosed in FIGS. 6A, 6B and 6C.

The fluid configuration portion 14' includes a housing 30 having a projection portion 32 having a flange 34 disposed thereon. The projection portion 32 extends through bore 50 (shown in FIG. 3A) such that the flange 34 engages the seat 52 to lock the fluid configuration portion 14' in place on the printhead 12. The fluid configuration portion 14' makes use of a guide portion 36 for engaging the complimentary guide portion 38 associated with printhead 12 for guiding the projection portion 32 into the bore 50 in a manner similar to the configuration portion 14 previously discussed.

The configuration portion 14' includes a fluidic interface 70 for engaging the complimentary fluidic interface 44' associated with the supply of ink 16'. The fluidic interface 70 is a septum type fluidic interface having a slot for receiving a hollow needle or projection portion similar to the septum type fluidic interface 44 associated with the supply of ink 16 shown in FIG. 2.

The fluidic interface 44' associated with the supply of ink 16' includes a hollow needle portion 72 having a blind bore 74. The hollow needle portion 72 is inserted through the septum 64 that is held in place by a crimp-cap 66. The insertion of the needle portion 72 through the septum 64 establishes fluid communication between the fluid configuration portion 14' and the supply of ink 16'.

FIGS. 7A, 7B, and 7C are intended to illustrate one alternative embodiment of the fluid interface associated with the fluid configuration portion 16 shown in FIGS. 1–6. The fluid configuration portion 14 and 14' can also be configured for connection to ink supplies 16 that use various other types of fluid interconnects.

In operation, the printhead 12 is configured for the particular printing system in which the printhead 12 is to be used. This configuration includes selecting the particular fluid configuration portion 14, 14' from a plurality of fluid configuration portions each associated with a particular supply of ink 14. For example, the fluid configuration portion 14, 14' may be unique to a particular printing system or unique to a particular color or ink type within a printing system. Once the fluid configuration portion 14 and 14' are selected the printhead 12 is then configured by attaching the selected configuration portion 14, 14' to the printhead 12.

Configuring the printhead 12 includes aligning the guiding portion 36 associated with the fluid configuration portion 14 with the guiding portion 38 associated with the printhead 12 in the X and Y axes. The configuration portion 14 is then urged towards the fluid inlet 26 associated with the printhead 12 as the fluid configuration portion 14 and 14' is moved along the Z axis. As the projection portion 32 extends into the bore 50 of the fluid inlet 26 the flange 34 is compressed. As the fluid configuration portion 14, 14' is further urged along the Z axis towards the fluid inlet 26 the flange 34 expands and engages the seat 52 locking the fluid configuration portion 14, 14' to the printhead 12, shown in FIG. 5. This snap-fit or compression fitting formed between the flange 34 and the seat 52 tends to produce a permanent attachment of the fluid configuration portion 14, 14' to the printhead 12 which resists removal of the fluid configuration portion 14. In addition, this snap-fit seal tends to prevent ink leakage between the projection portion 32 and the bore 50.

An important aspect of the present invention is that the printhead 12 does not need to be configured for the particular system until a final manufacturing step of attaching the fluid configuration portion 14, 14' to the printhead 12. Furthermore, the fluid configuration portion 14, 14' can be unique to ink colors and ink types. For this case, once one ink color of ink type is selected the corresponding fluid configuration portion 14, 14' is attached the printhead 12 and the printhead 12 is filled with the selected ink. By delaying the customization of the printhead 12 to one of the final manufacturing steps, inventory can be more easily controlled as well as inventory costs can be reduced. Using this technique complete printheads need not be kept in inventory.

Instead, an inventory of relatively inexpensive fluid configuration portions 14, 14' are kept in inventory as well as a smaller supply of unconfigured printhead portions 12. This arrangement allows greater flexibility in inventory control thereby reducing manufacturing costs.

What is claimed is:

1. An ink-jet pen having a fluid inlet portion configurable for connection to any one of a plurality of different types of fluid outlets of a plurality of supplies of ink, the ink-jet pen comprising:

a printhead responsive to control signals for selectively depositing ink;

a printhead housing, the printhead housing supporting the printhead, the printhead housing including the fluid inlet portion and a fluid inlet interconnect portion; and a fluid configuration portion selected from a plurality of fluid configuration portions for configuring the fluid inlet portion for connection to one of the plurality of different types of fluid outlets of the plurality of supplies of ink, the fluid configuration portion including:

an ink supply interconnect portion of a plurality of different types of ink supply interconnect portions, the ink supply interconnect portion being connectable to one type of fluid outlet of a corresponding supply of ink of the plurality of different types of fluid outlets of the plurality of supplies of ink;

a printhead housing interconnect portion, the fluid inlet interconnect portion of the printhead housing being configured for receiving the printhead housing interconnect portion of the fluid configuration portion, wherein complete insertion alone of the printhead housing interconnect portion into the fluid inlet interconnect portion, forms a non-releasable fluid interconnect between the fluid inlet portion and the fluid configuration portion to connect the printhead to the corresponding supply of ink.

2. The ink-jet pen of claim 1 wherein the fluid inlet interconnect portion of the fluid inlet portion includes a bore and a seat portion, and wherein the printhead housing interconnect portion of the fluid configuration portion includes a corresponding projection portion and a flange associated with the projection portion, such that upon press fit insertion of the projection portion into the bore, the seat portion engages the flange to secure the fluid configuration portion to the printhead housing.

3. The ink-jet pen of claim 2 wherein the projection portion of the fluid configuration portion defines a hollow passage therein such that insertion of the projection portion into the bore of the fluid inlet interconnect portion establishes fluid communication between the printhead and the fluid configuration portion.

4. The ink-jet pen of claim 2 wherein when the fluid inlet portion and the fluid configuration portion are press fit together, the flange of the projection portion engages the seat portion of the bore to form the non-releasable fluid interconnect between the printhead housing and the corresponding supply of ink.

5. The ink-jet pen of claim 4 wherein the non-releasable fluid interconnect between the fluid inlet portion of the printhead housing and the printhead housing interconnect portion of the fluid configuration portion is a permanent fluid interconnect that, upon attempted separation of the permanent fluid interconnect, results in operation affecting damage to at least one of the printhead housing and the fluid configuration portion.

6. A fluid configuration portion for connection to an ink-jet printhead having a housing defining a bore, the fluid configuration portion configuring the ink-jet printhead for connection to a selected one of a plurality of ink supplies, the fluid configuration portion comprising:

a first connector configured for insertion into the bore, wherein complete insertion alone of the first connector into the bore, forms a connection that non-releasably secures the fluid configuration portion to the printhead housing; and a second connector in fluid communication with the first connector, the second connector being configured for releasable connection to the selected one of the plurality of ink supplies.

7. The fluid configuration portion of claim 6 wherein the printhead housing defines a seat adjacent to the bore, and wherein the first connector includes a hollow cylindrical protruding member formed of a compliant material, the hollow cylindrical protruding member extending from a housing portion of the fluid configuration portion, the hollow cylindrical protruding member having an end portion opposite the housing portion, the end portion having a flange, the hollow cylindrical protruding member and flange being sized such that upon insertion into the bore of the printhead housing, the flange is first compressed and then allowed to expand so that the flange engages the seat of the bore to form a snap fit between the fluid configuration portion and the printhead housing.

8. A system for configuring an ink-jet pen, configured for selectively depositing ink in response to printhead control signals, the ink-jet pen including a fluid inlet, for use in any one selected ink-jet printing system of a plurality of ink-jet printing systems, the plurality of ink-jet printing systems of the type having an external ink supply such that with the ink-jet pen properly inserted into the ink-jet printing system, ink is provided from the external ink supply to the ink-jet pen, the system for configuring an ink-jet pen comprising:

a plurality of different types of fluid inlet adapters, each different type of fluid inlet adapter configuring the ink-jet pen for connection to only one selected ink-jet printing system of the plurality of ink-jet printing systems, each different type of fluid inlet adapter having:

a protruding portion configured for insertion into the fluid inlet of the inkjet pen;

a flange formed of a compliant material and disposed on the protruding portion, such that upon insertion of the protruding portion into the fluid inlet, the flange is first compressed and then allowed to expand so that the flange engages the fluid inlet to alone form a non-releasable snap fit connection to the fluid inlet of the ink-jet pen; and a unique printer interface configured for connection to only one selected ink-jet printing system of the plurality of ink-jet printing systems, the only one selected ink-jet printing system providing proper ink to the ink-jet pen for accomplishing printing.

9. The system for configuring an ink-jet pen of claim 8 wherein the non-releasable snap fit connection formed between the fluid inlet of the ink-jet pen and the protruding portion of the fluid inlet adapter is a permanent snap fit connection that, upon attempted separation of the permanent snap fit connection, results in operation affecting damage to at least one of the ink-jet pen and the fluid inlet adapter.

10. An ink-jet pen fluid configuration portion selected from a plurality of ink-jet pen fluid configuration portions capable of adapting a single type of ink-jet pen having a fluid inlet interconnect portion for connection to any one of a plurality of different types of fluid outlets of a plurality of supplies of ink, each ink-jet pen fluid configuration portion selected from the plurality of ink-jet pen fluid configuration portions comprising:

a housing;

an ink supply interconnect portion associated with the housing, the ink supply interconnect portion being of a type different than ink supply interconnect portions of remaining ink-jet pen fluid configuration portions of the plurality of ink-jet pen fluid configuration portions, the ink supply interconnect portion being connectable to only a corresponding fluid outlet of a corresponding supply of ink of the plurality of different types of fluid outlets of the plurality of supplies of ink;

a printhead housing interconnect portion associated with the housing and in fluid communication with the ink supply interconnect portion, the printhead housing interconnect portion being configured for coupling with the fluid inlet interconnect portion of the ink-jet pen, wherein complete coupling alone, of the printhead housing interconnect portion with the fluid inlet interconnect portion, forms a non-releasable fluid interconnect between the fluid inlet interconnect portion and the fluid configuration portion for adapting the single type of ink-jet pen to the corresponding supply of ink.

* * * * *